United States Patent [19]

Sato et al.

[11] 4,389,628

[45] Jun. 21, 1983

[54] THERMO-MAGNETICALLY OPERATED SWITCHES HAVING TWO DIFFERENT OPERATING TEMPERATURES

[75] Inventors: Hiroyasu Sato; Yoshiharu Sato; Tetsuro Baba, all of Sendai, Japan

[73] Assignee: Tohoku Metal Industries, Ltd., Miyagi, Japan

[21] Appl. No.: 268,132

[22] Filed: May 29, 1981

[30] Foreign Application Priority Data

| | | | |
|---|---|---|---|
| Jun. 2, 1980 | [JP] | Japan | 55-75140[U] |
| Jun. 4, 1980 | [JP] | Japan | 55-76620[U] |
| Jun. 4, 1980 | [JP] | Japan | 55-76621[U] |
| Jun. 12, 1980 | [JP] | Japan | 55-82137[U] |
| Jun. 12, 1980 | [JP] | Japan | 55-82138[U] |

[51] Int. Cl.[3] ..... H01H 36/00

[52] U.S. Cl. ..... 335/208; 335/207

[58] Field of Search ..... 335/208, 146, 207

[56] References Cited

U.S. PATENT DOCUMENTS 3,895,328 7/1975 Kato et al. ..... 335/208

*Primary Examiner*—Harold Broome

*Attorney, Agent, or Firm*—Posnack, Roberts, Cohen & Spiecens

[57] ABSTRACT

A thermo-magnetically operated switch having lower and higher operating points is maintained open below the lower operating point and above the higher operating point and is maintained closed between the two different operating points, and comprises a reed switch, two permanent magnets disposed alongside the reed switch over the respective reeds, a first ferromagnetic body having a Curie point corresponding to the higher operating point and disposed between the two magnets, and a second ferromagnetic body or bodies having a Curie point corresponding to the lower operating point and disposed along the two magnets. In order to improve reliability of the switch, two third ferromagnetic bodies having Curie points at or above the lower operating point are disposed to engage axial opposite ends of the second ferromagnetic body or bodies and the other pole faces of the magnets opposite the pole faces engage the first ferromagnetic body. The third ferromagnetic bodies may be integrally formed with the second ferromagnetic body or bodies.

20 Claims, 17 Drawing Figures

THERMO-MAGNETICALLY OPERATED SWITCHES HAVING TWO DIFFERENT OPERATING TEMPERATURES

BACKGROUND OF THE INVENTION

This invention relates to thermo-magnetically operated switches which utilize the saturation flux density versus the temperature characteristic of a magnetic substance to control the switching temperature, and, in particular, to improvements in thermomagnetically operated switches having two different and predetermined lower and higher operating points on a temperature axis so that it may be maintained open below the lower operating point and above the higher operating points. This type will be referred to as an open-close-open type.

Mr. H. Satoh, one of the joint inventors of this invention, proposed thermo-magnetically operated switches having two different operating points, in U.S. Pat. No. 3,895,238 together with three other inventors Mr. Kato, Mr. Endo and Mr. Horiuchi, wherein two permanent magnets and two kinds of magnetic members having different Curie points are assembled on the outer surface of a reed switch.

In the arrangements of FIGS. 4A–8B of the aforesaid U.S. patent, two magnets are disposed in cascade alongside a reed switch with a high temperature sensitive ferromagnetic body interposed between the magnets, and a low temperature sensitive ferromagnetic body or bodies are overlapped on the two magnets. At a temperature below the lower operating point, magnetic flux from the magnets flows in a closed loop through the two ferromagnetic substances so that the reed switch is maintained open. At an elevated temperature above the lower operating point, magnetic flux from the magnets flows through both reeds to close the reed switch. At a further elevated temperature above the higher operating point, magnetic flux from respective magnets flows through respective reeds so that the reed switch is open.

However, in the arrangements as shown in FIGS. 4A–8B of the U.S. patent, a part of the magnetic flux is apt to leak to the reeds even if the temperature is below the lower operating point. As a result, the switch is erroneously closed. For this reason, exchange of magnetic-flux flow path from the reeds to the low temperature sensitive ferromagnetic body is not always effected at a predetermined temperature at a time of the temperature drop, and the restoring point varies.

SUMMARY OF THE INVENTION

Accordingly, it is an object of this invention to provide a thermo-magnetically operated switch of the open-close-open type wherein the two operating points do not vary but are reliably maintained at the predetermined points.

It is another object of this invention to provide a thermomagnetically operated switch of the open-close-open type wherein the above object is realized with a simple construction.

It is still another object of this invention to provide a thermo-magnetically operated switch of the open-close-open type which is excellent in temperature responsibility and of reliability and long life.

According to this invention, a thermo-magnetically operated switch of the open-close-open type includes an elongated reed switch having a pair of ferromagnetic reeds hermetically sealed in an envelope with free ends of the reeds overlapped for opening and closing movements relative to one another. Two permanent magnets having Curie points higher than the higher operating point are disposed alongside the reed switch over the respective reeds in similar polar directions. A first ferromagnetic body having a Curie point corresponding to the higher operating point is disposed over the overlapped ends of the reeds and in an axial space between the two magnets to engage the two magnets. Second ferromagnetic body means having a Curie point corresponding to the lower operating point are disposed along the two magnets to short-circuit magnetically the two magnets at a temperature of the lower operating point or below. Two third ferromagnetic bodies having Curie points of the lower operating point or above are disposed to engage axial opposite ends of the second ferromagnetic body means and the other pole faces of the magnets opposite the pole faces thereof engaging the first ferromagnetic body.

The third ferromagnetic bodies may be integrally formed with the second ferromagnetic body means of a magnetic substance, or formed as members different from the second ferromagnetic body means.

Further objects, features and aspects of this invention will be understood from the following detailed description of preferred embodiments of this invention referring to the accompanying drawings.

DETAILED DESCRIPTION OF PREFERRED EMBODIMENTS

Figure 1A:
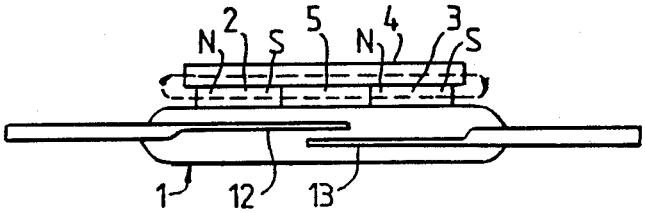
Fig.1a. PRIOR ART
FIGS. 1*a*–1*c* are sectional views of different arrangements of known thermo-magnetically operated switches of the open-close-open type.
Figure 1B:
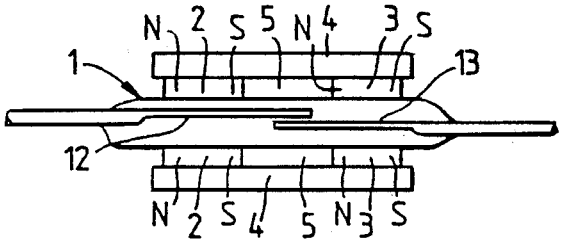
Fig.1b. PRIOR ART
Figure 1C:
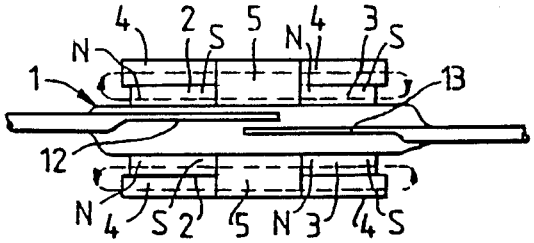
Fig.1c. PRIOR ART

Different known arrangements of thermo-magnetically operated switches of the open-close-open type are shown in FIGS. 1*a*–1*c*. Each switch shown in the figures includes a reed switch 1 having a glass envelope 11 and a pair of reeds 12 and 13, two permanent magnets 2 and 3, and two kinds of temperature sensitive magnetic members 4 and 5. The arrangements as shown in FIGS. 1*a*–1*c* respectively correspond to the switches in FIGS. 4A, 5 and 6 of U.S. Pat. No. 3,895,328. The description of the arrangements and operations of the switches as shown in FIGS. 1*a*–1*c* will be omitted for purposes of simplification of the description because they are completely understood by reference to the U.S. patent.

In those switches, the lower operating point is not maintained constant but varies because a part of magnetic flux from the magnets is apt to leak to reeds 12 and 13 of the reed switch 1, even if the temperature is below the Curie point of the lower temperature sensitive magnetic member 4, as described hereinbefore. Accordingly, those switches do not have good reliability.

This invention attempts to improve the switches of FIGS. 1*a*–1*c*.

Figure 2A:
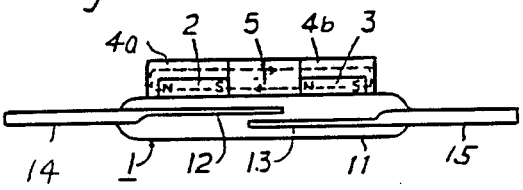
FIGS. 2*a*–2*c* are sectional views for explaining the arrangement and operation of an embodiment according to this invention.
Figure 2B:
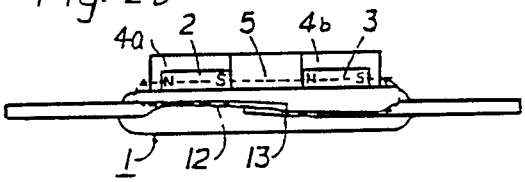
Figure 2C:
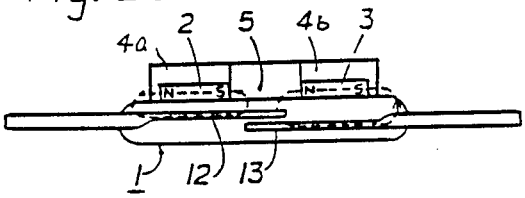

Referring to FIGS. 2*a*–2*c*, an embodiment of this invention comprises a reed switch 1, two permanent magnets 2 and 3, low temperature sensitive ferromagnetic members 4*a* and 4*b*, and high temperature sensitive ferromagnetic member 5.

The reed switch, as well known, comprises an elongated envelope 11, which is preferably made of glass, a pair of reeds 12 and 13 hermetically sealed therein, which are made of ferromagnetic and electroconductive materials with the ends thereof being overlapped for opening and closing movements relative to one another, and lead wires 14 and 15 connected to respective reeds, sealed to opposite ends of glass envelope 11 and outwardly extending therefrom.

Permanent magnets 2 and 3 have higher Curie points exceeding the operating temperature range of the switch and may be made of magnets selected from various known types of magnets.

Low temperature sensitive ferromagnetic members 4*a* and 4*b* have a Curie point corresponding to a predetermined lower temperature within the operating temperature range of the switch and are formed in an L-shaped configuration. High temperature sensitive ferromagnetic member 5 has a Curie point corresponding to a predetermined temperature within the operating temperature range. These temperature sensitive ferromagnetic members 4*a*, 4*b* and 5 are made of ferrite or other ferromagnetic material having a desired Curie point.

Permanent magnets 2 and 3 are mounted on and secured by adhesive to the outside of glass envelope 11 of reed switch 1 in such fashion that they are disposed in similar magnetizing directions alongside reed switch 1 at different axial positions and parallel with respective reeds 12 and 13, but short of not only the overlapped ends of the reeds but of opposite ends of the reed switch.

High-temperature ferromagnetic member 5 is interposed between the two magnets 2 and 3 to engage the magnets and is disposed over the overlapped ends of reeds 12 and 13. High-temperature sensitive ferromagnetic member 5 is thicker than each of magnets 2 and 3 to project outwardly beyond the outer surface of each magnet. The L-shaped lower-temperature sensitive ferromagnetic members 4*a* and 4*b* are overlapped on respective magnets 2 and 3 and cover and engage the other pole faces of magnets 2 and 3 opposite the pole faces engaging high-temperature sensitive ferromagnetic member 5. Opposite ends of a portion of high-temperature sensitive ferromagnetic member 5 projecting beyond the outer surface of each magnet engage adjacent axial ends of respective L-shaped lower-temperature sensitive ferromagnetic members 4*a* and 4*b*.

When the temperature of an observed object (or of the environment) is lower than the Curie points of lower and high temperature sensitive ferromagnetic members 4*a*, 4*b* and 5, magnetic flux from both of the permanent magnets 2 and 3 flows through both of the ferromagnetic members 4*a*, 4*b* and member 5. Thus, the overlapped ends of reeds 12 and 13 are maintained open, as illustrated in FIG. 2*a*.

When the temperature is elevated above the Curie points of lower-temperature sensitive ferromagnetic members 4*a* and 4*b*, the magnetic flux flows through reeds 12 and 13 and high-temperature sensitive ferromagnetic member 5 because lower-temperature sensitive ferromagnetic members 4*a* and 4*b* turn non-magnetic. The magnetic strength between the overlapped ends of reeds 12 and 13 then overcomes the elasticity of each reed to permit the overlapped ends to close, as shown in FIG. 2*b*.

When the temperature is further elevated above the Curie point of high-temperature sensitive ferromagnetic member 5, magnetic flux from magnet 2 flows only through the adjacent reed 12 while flux from the other magnet 3 flows only through the other reed 13, because the overcoming elasticity of the reeds present between the overlapped ends of reeds 12 and 13, and the overlapped ends are opened, as shown in FIG. 2*c*.

In the arrangement, since each of lower-temperature sensitive ferromagnetic members 4*a* and 4*b* is L-shaped and covers and engages a pole face of each magnet opposite the other pole face engaging with high-temperature sensitive ferromagnetic member 5, all of the flux from each magnet 2 and 3 flows through each lower-temperature sensitive ferromagnetic member 4*a* and 4*b* at a temperature at or below the Curie point of each lower-temperature sensitive ferromagnetic members 4*a* and 4*b*, so that the leakage flux through reeds 12 and 13 is substantially reduced to be about zero. Accordingly, reed switch 1 is protected from being erroneously closed at a temperature at or below the Curie point of lower-temperature sensitive ferromagnetic members 4*a* and 4*b*. Furthermore, the exchange of the magnetic flux path from reeds 12 and 13 to low-temperature sensitive ferromagnetic members 4*a* and 4*b* is reliably effected at a constant temperature during the temperature drop. Thus, a thermomagnetically operated switch of the open-close-open type is obtained which has excellent temperature response and reliability. Furthermore, since the lower restoring temperature point of the switch is automatically maintained constant, no specific care must be taken to maintain it constant so that the assembly of the switch is simplified.

Figure 3:
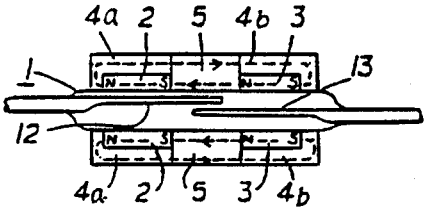
FIGS. 3–13 are sectional views of different embodiments of this invention.

In a modification, two magnets 2 and 3, two L-shaped lower-temperature sensitive ferromagnetic members 4*a* and 4*b* and high-temperature ferromagnetic member 5 are cylindrical and are assembled and mounted around reed switch 1 by fitting them on one another, as shown in FIG. 3.

Figure 4:
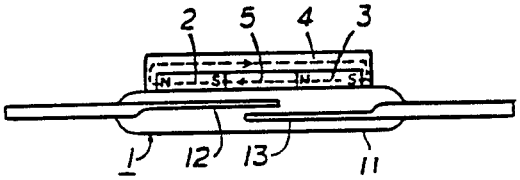

Referring to FIG. 4, the lower-temperature sensitive ferromagnetic members may be formed as an integral single part 4 which straddles high-temperature sensitive ferromagnetic member 5. In the arrangement, the high-temperature sensitive ferromagnetic member 5 is preferably formed with a thickness similar to that of each magnet 2 and 3 as shown in the figure. Two magnets 2 and 3, low-temperature sensitive ferromagnetic member 4 and high-temperature sensitive ferromagnetic member 5 may be to cylindrical form and assembled around the reed switch, similar to FIG. 3.

If magnetic yokes are used to engage a lower-temperature sensitive ferromagnetic member or members and to cover pole faces of magnets, each lower-temperature sensitive ferromagnetic member must not be of an L-shaped form.

Figure 5:
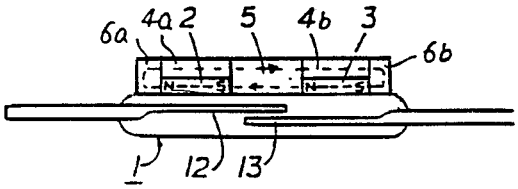

Referring to FIG. 5, respective lower-temperature ferromagnetic members 4*a* and 4*b* are formed of a single bar-shape, and overlie respective magnets 2 and 3 to engage both ends of a portion of high-temperature sensitive member 5 projecting beyond the outer surface of magnets 2 and 3. A magnetic yoke 6*a* is disposed to engage the pole face of magnet 2 and the axial end surface of low-temperature sensitive ferromagnetic member 4*a*, their opposite end surfaces engaging high-temperature sensitive ferromagnetic member 5. Another magnetic yoke 6*b* is disposed to engage the pole face of magnet 3 and the axial end surface of lower-temperature sensitive ferromagnetic member 4*b*, their opposite end surfaces engaging high-temperature sensitive ferromagnetic member 5. Each yoke 6*a* and 6*b* is made of a ferromagnetic substance having a Curie point equal to, or higher than, that of each lower-temperature sensitive ferromagnetic member.

In this arrangement, at a temperature at or below the Curie point of each lower-temperature sensitive ferromagnetic member 4a and 4b, almost all of the magnetic flux from magnets 2 and 3 flows to lower-temperature sensitive ferromagnetic members 4a and 4b through yokes 6a and 6b. Therefore, reed switch 1 is also protected from being closed erroneously.

Figure 6:
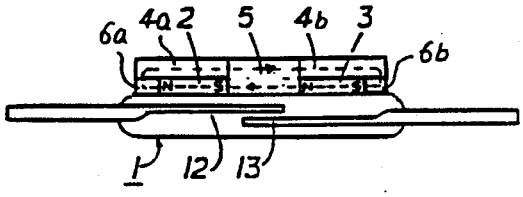

In a modification, each lower-temperature sensitive ferromagnetic member 4a and 4b may be extended to project axially beyond each magnet in an opposite direction of high-temperature ferromagnetic member 5, as shown in FIG. 6. Each magnetic yoke 6a and 6b is disposed to engage the projecting portion of each lower-temperature sensitive ferromagnetic member 4a and 4b at its bottom surface and the pole face of each magnet.

Figure 7:
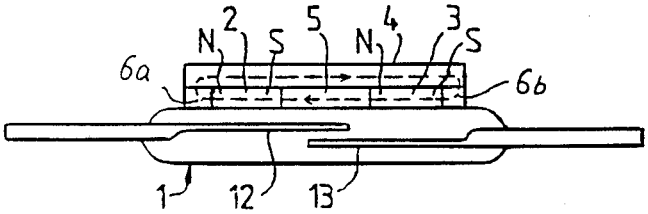

The lower-temperature sensitive ferromagnetic members may be formed as an integral single part 4, as shown in FIG. 7. The single part of lower-temperature sensitive ferromagnetic member 4 straddles high-temperature sensitive ferromagnetic member 5 which is formed with a thickness similar to that of each magnet 2 and 3.

In connection with embodiments of FIGS. 5–7, magnets 2 and 3, lower-temperature sensitive ferromagnetic member 4 or members 4a and 4b, high-temperature sensitive ferromagnetic member 5 and magnetic yoke 6a and 6b may be formed as cylindrical parts which are mounted around the reed switch, similar to FIG. 3.

Figure 8:
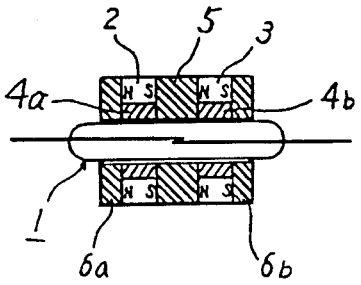

Lower-temperature sensitive ferromagnetic members 4a and 4b may be disposed between magnets 2 and 3 and reed switch 1, as shown in FIG. 8. In this arrangement, each yoke 6a and 6b may have a Curie point higher than that of high-temperature sensitive ferromagnetic member 5 so that magnetic flux from magnets 2 and 3 is effectively introduced to reeds 12 and 13 at a temperature above the Curie point of the lower-temperature sensitive ferromagnetic members 4a and 4b.

Figure 9:
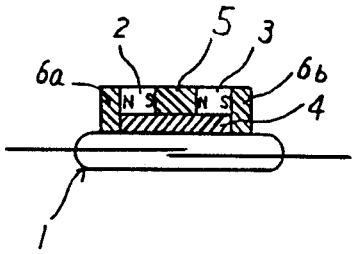

The lower-temperature sensitive ferromagnetic members may be also integrally formed with one another as a single part 4, as shown in FIG. 9.

Each lower-temperature sensitive ferromagnetic member may be separated into two parts, one of which is disposed between the magnet and the reed switch with this other one disposed on the magnet. In the arrangement, each magnetic yoke engages with two parts of each lower-temperature sensitive ferromagnetic member and the magnet. The magnetic yoke may be also integrally formed with the two parts.

Referring to FIGS. 10–13, each lower-temperature sensitive ferromagnetic member 4a and 4b is formed to have a generally C-shaped section, which encloses each magnet 2 and 3.

Figure 10:
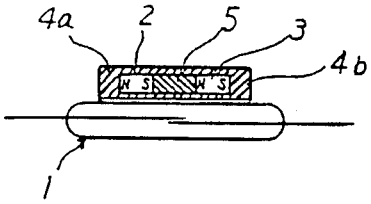

In FIG. 10, two C-shaped lower-temperature sensitive ferromagnetic members 4a and 4b are in contact with one another at their axial end edges to form a hollow space, in which two magnets 2 and 3 and high-temperature sensitive ferromagnetic member 5 are enclosed. In the arrangement, magnetic flux from magnets 2 and 3 flows through a closed magnetic path of both C-shaped members 4a and 4b at a temperature at or below the Curie point of the members. Therefore, no magnetic flux leaks to reeds 12 and 13.

Figure 11:
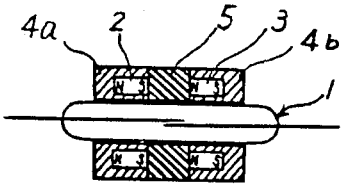
Figure 12:
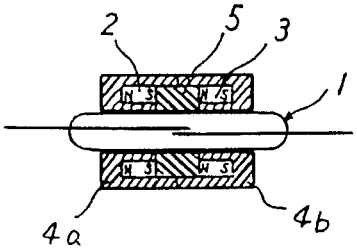
Figure 13:
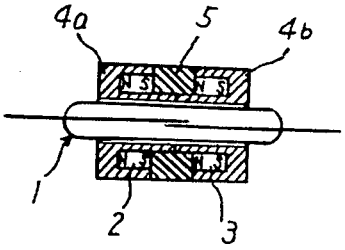

FIGS. 11–13 show different modifications wherein high-temperature sensitive ferromagnetic member 5 is thicker than that of each magnet 2 and 3 and wherein magnets 2 and 3, lower-temperature sensitive ferromagnetic members 4a and 4b and high-temperature sensitive ferromagnetic member 5 are formed as cylindrical parts. In FIG. 11, high-temperature sensitive ferromagnetic member 5 is exposed at the C-shaped lower-temperature sensitive ferromagnetic members at both the outer and inner surfaces. In FIG. 12, only the inner surface is exposed to contact envelope 11 of reed switch 1. In FIG. 13, only the outer surface is exposed.

In arrangements wherein magnets 2 and 3, high-temperature sensitive ferromagnetic member 5, lower-temperature sensitive ferromagnetic member or members 4a and 4b and yokes 6a and 6b are formed as cylindrical parts which are coaxially assembled on and around reed switch 1, a groove may be formed in the outer surface of the assembled cylindrical parts which axially extends over the axial length of the assembly, similar to groove 9 in FIGS. 7A–8B of U.S. Pat. No. 3,895,328. Then, one of lead wires 14 and 15 is introduced along the groove at the same side as the other lead wire.

The present invention has been described in connection with specific embodiments, but is not restricted to the specific illustrated and described embodiments. Various and other modifications and alterations are clearly possible within the scope of the invention as defined in the appended claims.

What is claimed is:

1. In a thermo-magnetically operated switch having two different and predetermined lower and higher operating points on a temperature scale so that the switch may be maintained open below the lower operating point and above the higher operating point and be maintained closed between the two different operating points, which includes an elongated reed switch having a pair of ferromagnetic reeds hermetically sealed in an envelope with free ends of said reeds overlapped for opening and closing movements relative to one another, two permanent magnets having Curie points higher than said higher operating point and disposed alongside said reed switch over the respective reeds in similar polar directions, a first ferromagnetic body having a Curie point corresponding to said higher operating point and disposed over said overlapped ends of said reeds and in an axial space between said two magnets to engage said two magnets, and second ferromagnetic body means having a Curie point corresponding to said lower operating point and disposed alongside said two magnets to short-circuit magnetically said two magnets at the temperature of said lower operating point or below, the improvement comprising two third ferromagnetic bodies having Curie points of said lower operating point or above and disposed to engage axial opposite ends of said second ferromagnetic body means and the other pole faces of said magnets opposite the pole faces thereof engaging said first ferromagnetic body.

2. A thermo-magnetically operated switch as claimed in claim 1, wherein said second ferromagnetic body means are overlapped on said two magnets.

3. A thermo-magnetically operated switch as claimed in claim 2, wherein said second ferromagnetic body means comprises a ferromagnetic piece which overlies the outer surfaces of both magnets while straddling the first ferromagnetic body.

4. A thermo-magnetically operated switch as claimed in claim 2, wherein the outer surface of said first ferromagnetic body in the radial direction of the reed switch extends beyond the outer surfaces of said two magnets, said second ferromagnetic body means comprising first and second ferromagnetic pieces which overlie the respective surfaces of both magnets with an axial end of each of said first and second ferromagnetic pieces engaging an adjacent axial end of said first ferromagnetic body.

5. A thermo-magnetically operated switch as claimed in claim 3, wherein said second ferromagnetic body means and said two third ferromagnetic bodies are integral with one another.

6. A thermo-magnetically operated switch as claimed in claim 4, wherein said two third ferromagnetic bodies are integral with said first and second ferromagnetic pieces, respectively.

7. A thermo-magnetically operated switch as claimed in claim 3, wherein said ferromagnetic piece is axially extended to project beyond said two magnets at axial opposite ends, and said two third ferromagnetic bodies engage the bottom surfaces of opposite projecting end portions of said ferromagnetic pieces, respectively.

8. A thermo-magnetically operated switch as claimed in claim 4, wherein said first and second ferromagnetic pieces are axially extended to project beyond said two magnets at axial opposite ends, and said two third ferromagnetic bodies engage the bottom surfaces of said projecting end portions of said first and second ferromagnetic pieces, respectively.

9. A thermo-magnetically operated switch as claimed in claim 3, 5 or 7, wherein said two magnets, said first ferromagnetic body, said ferromagnetic piece and said two third ferromagnetic bodies are cylindrical and are coaxially assembled on and around said reed switch.

10. A thermo-magnetically operated switch as claimed in claim 4, 6 or 8, wherein said two magnets, said first ferromagnetic body, said first and second ferromagnetic pieces and said third ferromagnetic bodies are cylindrical and are coaxially assembled on and around said reed switch.

11. A thermo-magnetically operated switch as claimed in claim 1, wherein said second ferromagnetic body means comprises a ferromagnetic piece which is disposed under said two magnets and said first ferromagnetic body but on said reed switch.

12. A thermo-magnetically operated switch as claimed in claim 1, wherein said first ferromagnetic body is thicker than each said magnet, said second ferromagnetic body means comprising first and second ferromagnetic pieces which are interposed between respective magnets and said reed switch, said first ferromagnetic body being interposed axially between said first and second ferromagnetic pieces.

13. A thermo-magnetically operated switch as claimed in claim 11 or 12, wherein each of said two third ferromagnetic bodies is made of ferromagnetic materials having a Curie point higher than that of said first ferromagnetic body.

14. A thermo-magnetically operated switch as claimed in claim 11 or 12, wherein said two magnets, said first ferromagnetic body, said second ferromagnetic body means and said two third ferromagnetic bodies are cylindrical and are coaxially assembled on and around said reed switch.

15. A thermo-magnetically operated switch as claimed in claim 1, wherein said second ferromagnetic body means comprises first and second ferromagnetic pieces which are respectively disposed on the outer surfaces and the inner surfaces of said two magnets.

16. A thermo-magnetically operated switch as claimed in claim 15, wherein said first ferromagnetic piece is separated into two portions overlying respective outer surfaces of said two magnets while said second ferromagnetic piece is separated into two portions underlying respective inner surfaces of said two magnets, said separated portions of said first and second ferromagnetic pieces on the outer and inner surfaces of one of said magnets being integral with one of said third ferromagnetic bodies, and the other separated portions on the outer and inner surfaces of the other magnet being integral with the other third ferromagnetic body.

17. A thermo-magnetically operated switch as claimed in claim 16, wherein said first ferromagnetic body is interposed axially between said separated portions of said first ferromagnetic piece.

18. A thermo-magnetically operated switch as claimed in claim 16, wherein said first ferromagnetic body is interposed axially between said separated portions of said second ferromagnetic piece.

19. A thermo-magnetically operated switch as claimed in claim 16, wherein said first ferromagnetic body is interposed axially between said separated portions of said first ferromagnetic piece, and between said separated portions of said second ferromagnetic piece.

20. A thermo-magnetically operated switch as claimed in claim 17, 18 or 19, wherein said two magnets, said first ferromagnetic body, said first and second ferromagnetic pieces and said third ferromagnetic bodies are cylindrical and are coaxially assembled on and around said reed switch.

* * * * *

UNITED STATES PATENT AND TRADEMARK OFFICE

CERTIFICATE OF CORRECTION

PATENT NO. : 4,389,628

DATED : June 21, 1983

INVENTOR(S) : Hiroyasu Sato; Yoshiharu Sato; Tetsuro Baba

It is certified that error appears in the above-identified patent and that said Letters Patent are hereby corrected as shown below:

Column 1, line 21: change "3,895,238" to --3,895,328--

Column 4, line 46: change "to" to --of--

Column 5, line 47: change "this" to --the--; and change "the" (second occurrence)to --this--

Signed and Sealed this

*Twenty-second* Day of *November 1983*

[SEAL]

*Attest:*

GERALD J. MOSSINGHOFF

*Attesting Officer*

*Commissioner of Patents and Trademarks*